US009257795B2

(12) United States Patent
Smith

(10) Patent No.: US 9,257,795 B2
(45) Date of Patent: Feb. 9, 2016

(54) PUSH-ON TYPE GROUNDING BUSHING

(71) Applicant: Bridgeport Fittings, Inc., Stratford, CT (US)

(72) Inventor: Lawrence J. Smith, Stamford, CT (US)

(73) Assignee: BRIDGEPORT FITTINGS, INC., Stratford, CT (US)

( * ) Notice: Subject to any disclaimer, the term of this patent is extended or adjusted under 35 U.S.C. 154(b) by 87 days.

(21) Appl. No.: 14/262,946

(22) Filed: Apr. 28, 2014

(65) Prior Publication Data

US 2015/0311638 A1 Oct. 29, 2015

(51) Int. Cl.

| | |
|---|---|
| ***H01R 4/36*** | (2006.01) |
| ***H01R 13/655*** | (2006.01) |
| ***H01R 4/64*** | (2006.01) |

(52) U.S. Cl.

CPC ..... *H01R 13/655* (2013.01); *H01R 4/36* (2013.01); *H01R 4/643* (2013.01)

(58) Field of Classification Search

CPC ..... H01R 4/36; H01R 13/655
USPC ..... 174/51
See application file for complete search history.

(56) References Cited

U.S. PATENT DOCUMENTS

| | | | |
|---|---|---|---|
| 3,643,203 | A | 2/1972 | McLaughlin et al. |
| 3,967,872 | A | 7/1976 | Mooney et al. |
| 4,210,374 | A | 7/1980 | Churla |
| 4,248,490 | A | 2/1981 | Bachle |
| 4,536,613 | A | 8/1985 | Gallas |
| 5,364,281 | A | 11/1994 | Leto |
| 5,480,311 | A | 1/1996 | Luu |
| 6,011,218 | A | 1/2000 | Burek et al. |
| 6,797,877 | B1 | 9/2004 | Burnette |
| 6,817,895 | B2 | 11/2004 | Kiely |
| 6,903,267 | B2 | 6/2005 | Burnette |
| 7,005,574 | B2 | 2/2006 | Burnette |
| 7,005,581 | B2 | 2/2006 | Burnette |
| 7,126,064 | B1 | 10/2006 | Shemtov |
| 7,182,611 | B2 | 2/2007 | Borden et al. |
| 7,198,495 | B1 | 4/2007 | Youtsey |
| 7,488,905 | B2 | 2/2009 | Kiely et al. |
| D596,578 | S | 7/2009 | Kiely et al. |
| D618,626 | S | 6/2010 | Kiely |

(Continued)

OTHER PUBLICATIONS

"Cable Fittings terminate large MC cable in dry locations"; Apr. 8, 2013; Thomasnet.com; http://news.thomasnet.com/fullstory/Cable-Fittings-terminate-large-MC-cable-in-dry-locations-20006067.

"TITE-BITE Combination Couplings Armored Cable for Threaded Rigid—Rigid and Intermediate Metal Conduit Fittings"; PartCommunity.com; http://b2b.partcommunity.com/portal/portal/b2b/CAD+CATALOGS?info=thomas_betts/fittings/rigit_fittings/tite_bite_combinat_coupl_asmtab.prj.

"Grounding Clamps"; Bridgeport Fittings, Inc. Catalog; p. 93; Nov. 1, 2013.

(Continued)

*Primary Examiner* — Hung V Ngo
(74) *Attorney, Agent, or Firm* — Ware, Fressola, Maguire & Barber LLP

(57) ABSTRACT

A push-type grounding bushing has an electrically conductive body having a first end, a second end, a bore formed therethrough, and an intermediate shoulder stop to contact an end of a conduit. The bushing has with a locking device gripping tabs forming a helix so that the conduit can be pushed and held in the locking device and removed by rotating the conduit relative to the body. A throat insulator is placed into the second end of the body and has a flange to cover the second end. An electrically conducting lug is secured to the body and has a recess or bore for receipt of at least one electrical conductor to ground the bushing while a fastener mechanically and electrically secures the conductor to the lug.

14 Claims, 14 Drawing Sheets

(56) References Cited

U.S. PATENT DOCUMENTS

| | | | | |
|---|---|---|---|---|
| 7,758,356 | B2 | 7/2010 | Burris et al. | |
| 7,841,630 | B1 | 11/2010 | Auray et al. | |
| 8,106,297 | B1 | 1/2012 | Kiely | |
| 8,242,369 | B2 | 8/2012 | Kiely et al. | |
| 8,274,000 | B2 | 9/2012 | Smith | |
| 8,466,378 | B1 | 6/2013 | Gretz | |
| 8,474,877 | B2 | 7/2013 | Smith | |
| 8,487,197 | B2 | 7/2013 | Smith | |
| D733,064 | S * | 6/2015 | Smith | D13/149 |
| 2010/0041281 | A1 | 2/2010 | Quattro | |
| 2011/0287643 | A1 | 11/2011 | Lopez | |
| 2013/0189860 | A1 | 7/2013 | Pyron | |

OTHER PUBLICATIONS

"Insulating Bushing"; Bridgeport Fittings, Inc. Catalog; p. 43; Nov. 1, 2013.

Arlington EMT250 Product Information; Nov. 1, 2013; entire document.

Ground Lug; Nov. 1, 2013; entire document.

Lay-In Lugs: Solar Grounding Lugs; Nov. 1, 2013; entire document.

Midwest LT2006 2LT Connector Ground Lug; Nov. 1, 2013; entire document.

* cited by examiner

PUSH-ON TYPE GROUNDING BUSHING

TECHNICAL FIELD

The present invention relates in general to grounding bushings and, in particular, push-on type grounding bushings for a terminating end of a conduit having insulated electrical conductors extending out of the conduit.

BACKGROUND OF THE INVENTION

Grounding bushings are commonly used in the electrical fitting art and, in particular, are used to ground the bushing to an earth ground so as to electrically bond the grounding bushing and thus the conduit terminating in the bushing to earth ground. The grounding bushing may also electrically bond a grounding conductor within the conduit to earth ground.

SUMMARY OF THE INVENTION

The present invention relates to a push-type grounding bushing comprising an electrically conductive body having a first end and a second end, with a bore formed therethrough, the body further having an intermediate shoulder stop formed therein dimensioned to contact an end of a conduit passing into the body from the first end, a locking device placed in the first end of the body having a plurality of gripping tabs forming a helix so that the conduit can be pushed into the locking device and held by the plurality of gripping tabs and removed by rotating the conduit relative to the body, a throat insulator dimensioned for placement into the second end of the body, the throat having a flange dimensioned to substantially cover the second end, the throat insulator having a bore formed therein for passage of electrical conductors extending out of the conduit, an electrically conducting lug secured to the body, the lug having a recess or bore dimensioned for receipt of at least one electrical conductor for providing grounding of the bushing, and a fastener configured to mechanically and electrically securing the conductor received in the recess to the lug.

Another embodiment of the present invention is the push-type grounding bushing as described above, wherein the recess of the lug is dimensioned for receipt of an electrical conductor extending out of the conduit.

A further embodiment of the present invention is the push-type grounding bushing as described above, wherein the locking device has a plurality of gripping tabs forming a helix.

A still further embodiment of the present invention is the push-type grounding bushing as described above, wherein at least some of the gripping tabs have a twist formed therein.

Another embodiment of the present invention is the push-type grounding bushing as described above, wherein the first end of the electrically conductive body is rolled over so as to secure the locking device to the body.

A further embodiment of the present invention is the push-type grounding bushing as described above, further comprising a washer positioned adjacent the locking device and also secured to the rolled over first end of the body.

A further embodiment of the present invention is the push-type grounding bushing as described above, wherein an interior wall of the body between the second end of the body and the intermediate shoulder stop has a decreasing diameter stepped configuration and wherein the throat insulator has a corresponding outer wall dimensioned to mate with the stepped configuration of the interior wall.

A still further embodiment of the present invention is the push-type grounding bushing as described above, wherein the lug has a base attached to the body, the lug extending from the body of the grounding bushing and having first, second, third and fourth sides, and a top, the lug having a lay-in recess formed between the second and fourth sides and having an opening extending through the third side, the lay-in recess dimensioned for lay-in placement of an electrical conductor through the opening in the third side and positioned so as to extend across the second and fourth sides, a bore formed through the first side and extending into the recess so as to allow an electrical conductor to pass therethrough, and a threaded bore formed through the top and extending into the lay-in recess, the bore for receipt of a fastener configured to mechanically and electrically secure the at least one conductor to the lug.

Another embodiment of the present invention is the push-type grounding bushing as described above, wherein the lug is integrally attached to the body.

Another embodiment of the present invention is the push-type grounding bushing as described above, wherein the body includes a boss dimensioned for receipt of the lug and wherein the lug is secured to the boss by a fastener.

A further embodiment of the present invention is the push-type grounding bushing as described above, further comprising a contact rib formed on the intermediate shoulder stop extending into the bore in the body toward the first end of the body by an increasing radial dimension.

A further embodiment of the present invention is the push-type grounding bushing as described above, further comprising a washer positioned adjacent the locking device and placed in the first end of the body.

A still further embodiment of the present invention is the push-type grounding bushing as described above, wherein the body includes a boss dimensioned for securing the lug to the body by a fastener.

Another embodiment of the present invention is a lay-in type lug for attachment to a push-type grounding bushing having a boss dimensioned for receipt of the lug, the lug having a base, first, second, third and fourth sides and a top, the lug having a lay-in recess formed between the second and fourth sides and having an opening extending through the third side, the lay-in recess dimensioned for lay-in placement of an electrical conductor through the opening in the third side and positioned so as to extend across the second and fourth sides, a bore formed through the first side and extending into the recess so as to allow an electrical conductor to pass therethrough and a threaded bore formed through the top and extending into the lay-in recess, the bore for receipt of a fastener configured to mechanically and electrically secure the at least one conductor to the lug.

Another embodiment of the present invention is the lay-in type lug as described above, further comprising an extension to its base having a bore formed therein so as to secure the lug to a boss of a push-type grounding bushing.

DETAILED DESCRIPTION

Figure 1:
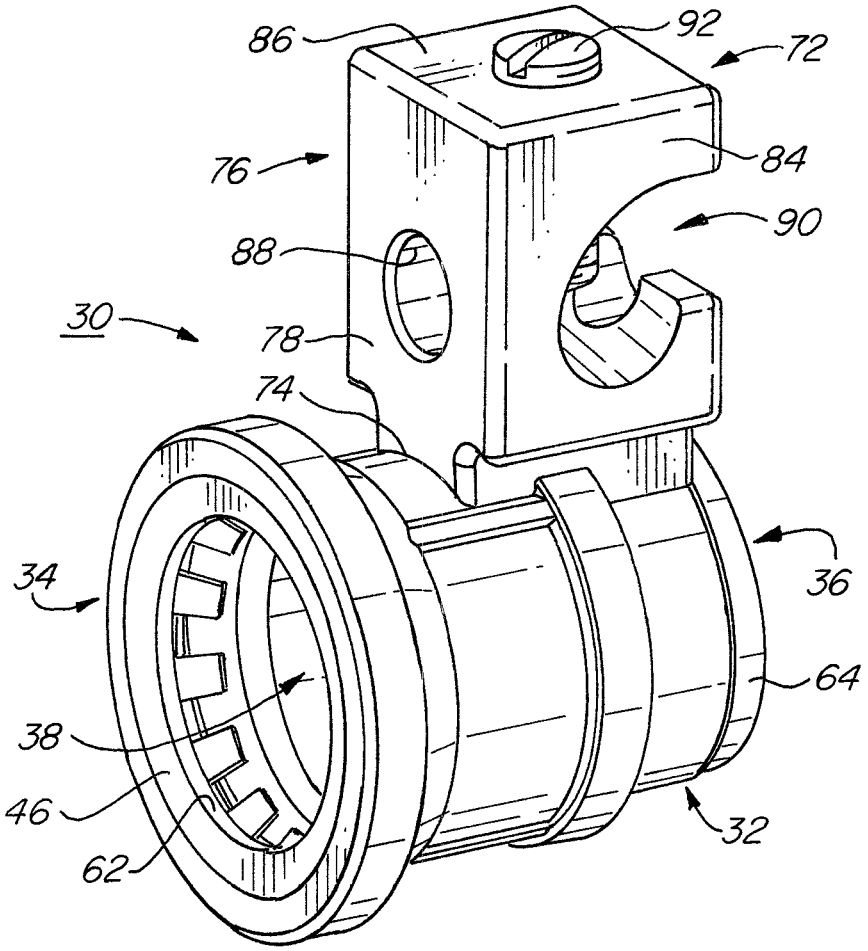
FIG. 1 is a perspective view of an embodiment of a push-on type grounding bushing according to the present invention having an integral lug.

FIG. 1 illustrates an embodiment of a push-on type grounding bushing 30 according to the present invention. As there seen, the grounding bushing includes a body 32 made from an electrically conductive material, such as a zinc alloy. Other electrically conductive metals may be used as well.

Figure 8:
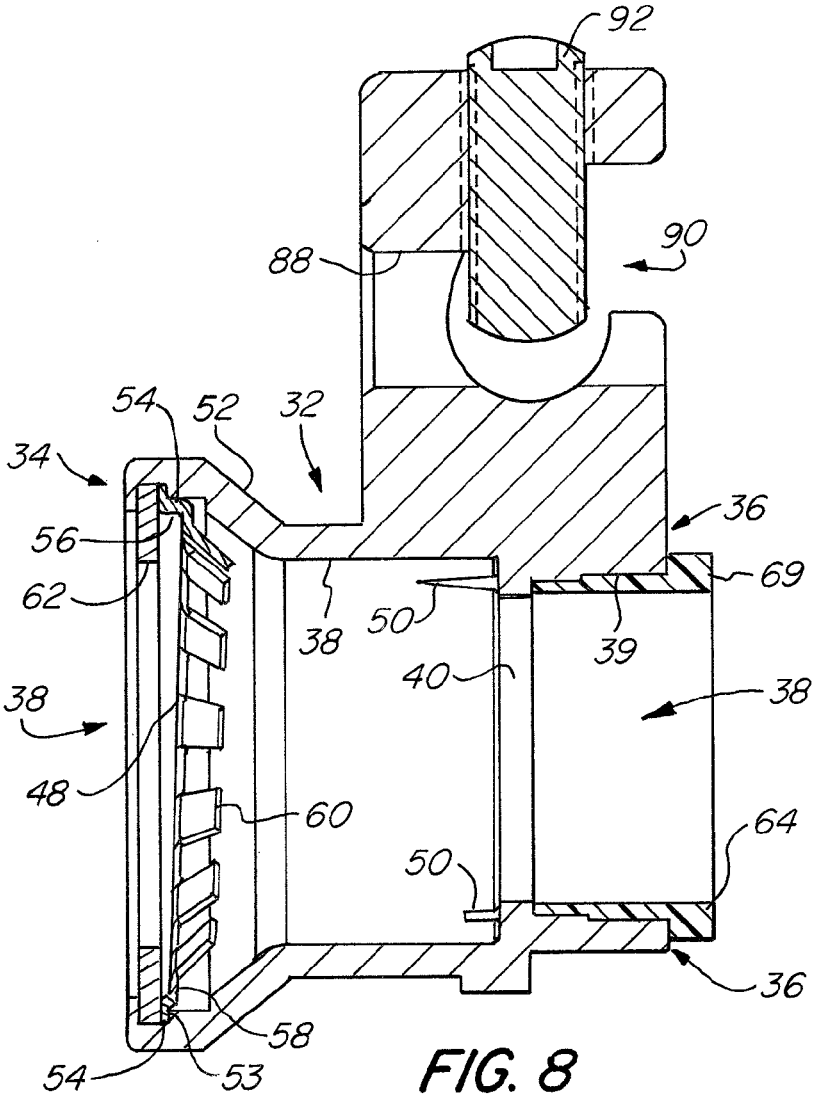
FIG. 8 is a cross-sectional view of the push-on type grounding bushing taken through the middle of the grounding bushing as shown in FIG. 1.
Figure 11:
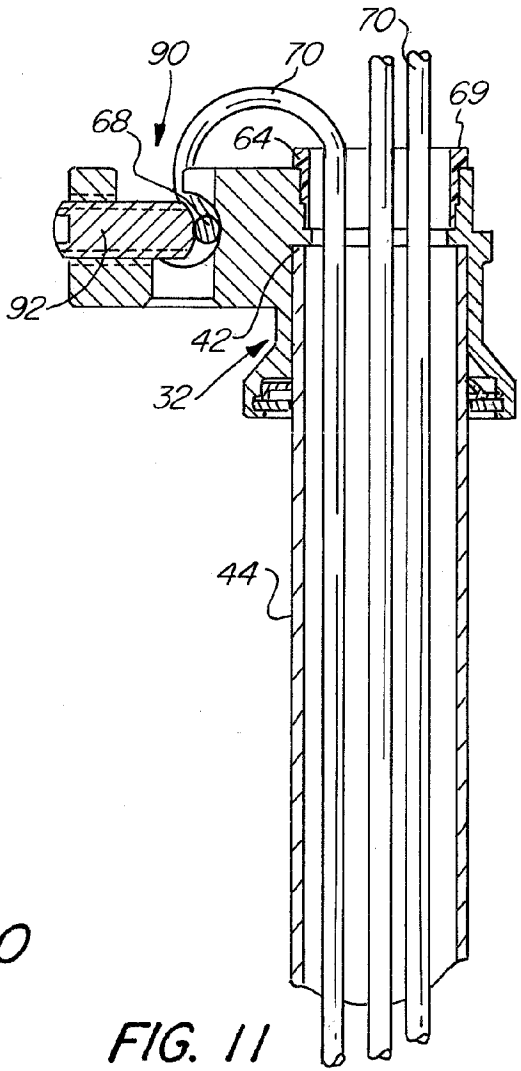
FIG. 11 is a cross-sectional view of the push-on type grounding bushing and conduit showing a grounding conductor in the conduit secured to the lug. This view is taken along line 11-11 of FIG. 10.

Body 32 has a first end 34 and a second end 36 with a bore 38 extending through the body. As seen in FIG. 8, the body further has an intermediate shoulder stop 40 dimensioned to contact an end 42 of a conduit (electrical metallic tubing) 44 as best seen in FIG. 11. The intermediate shoulder stop separates a first interior wall 37 and a second interior wall 39 of body 32. The second interior wall may have a decreasing diameter stepped configuration from the second end 36 of the body.

Figure 2:
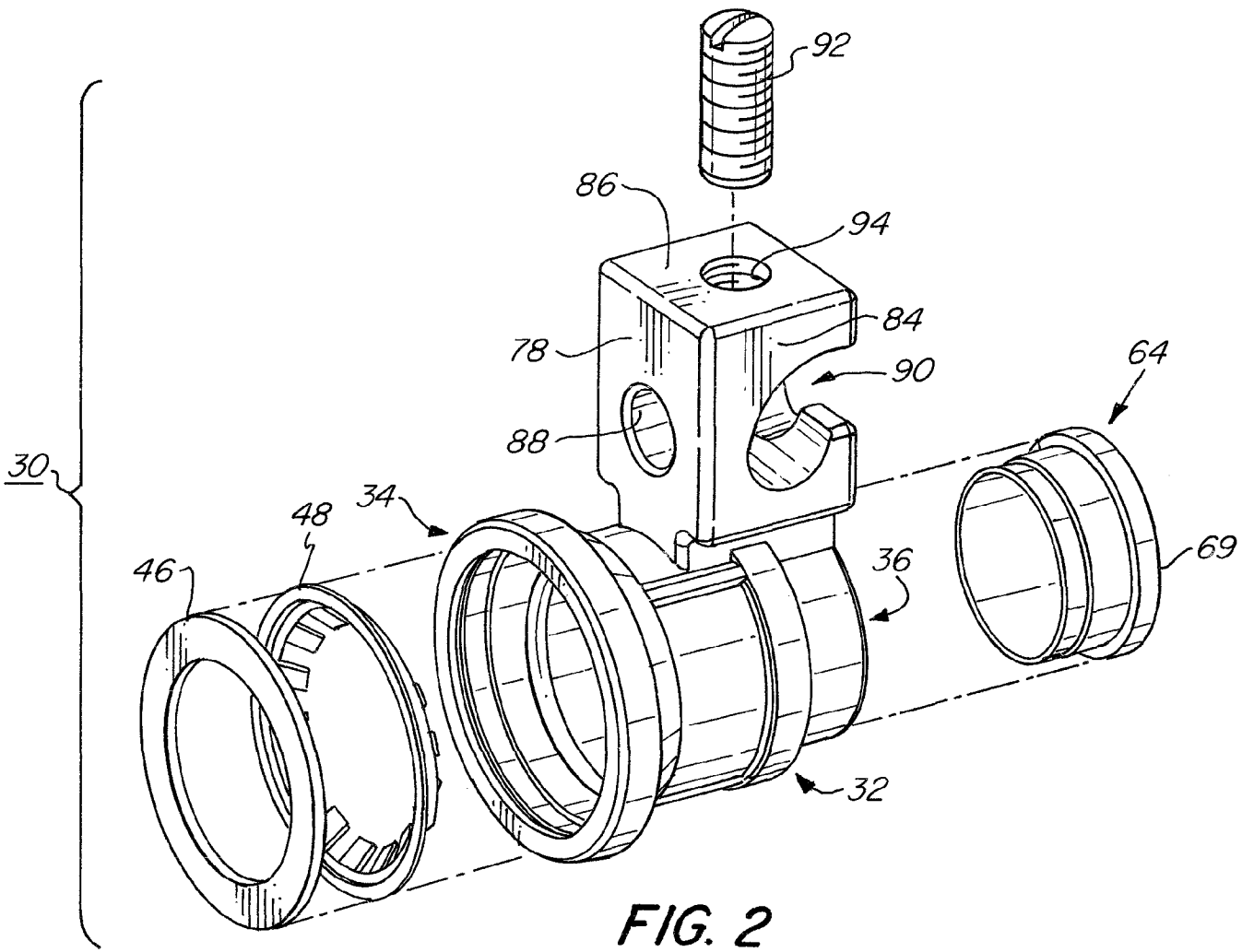
FIG. 2 is an exploded perspective view of the push-on type grounding bushing showing the washer and locking device outside of the body, but noting that the washer and locking device are captured inside the body by rolling over the shoulder of the body after the washer and locking device are inserted therein.
Figure 3:
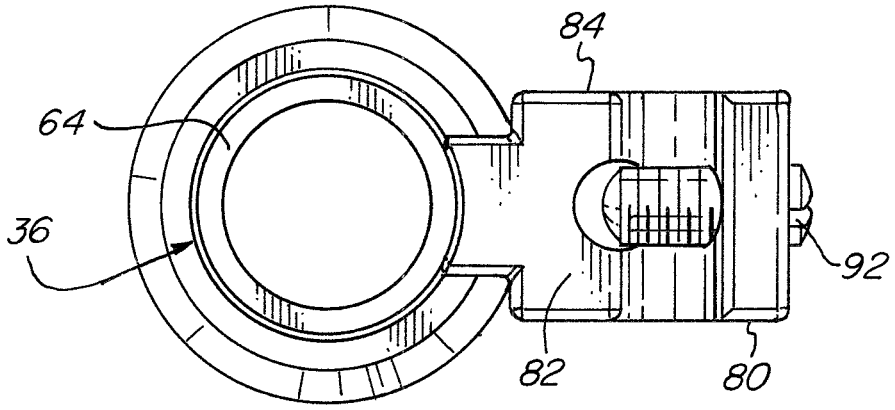
FIG. 3 is a rear view of the push-on type grounding bushing showing the bushing rotated 90° relative to the orientation of the bushing shown in FIG. 2.
Figure 4:
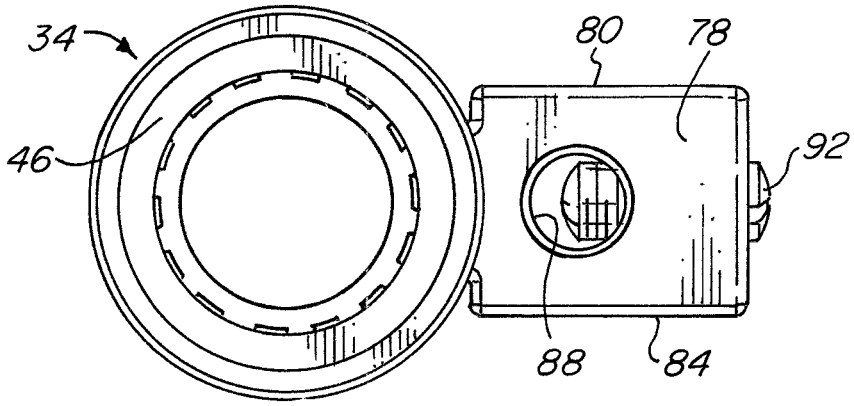
FIG. 4 is a front view of the push-on type grounding bushing showing the bushing rotated 90° clockwise from the frontal view of the bushing as shown in FIG. 2.
Figure 5:
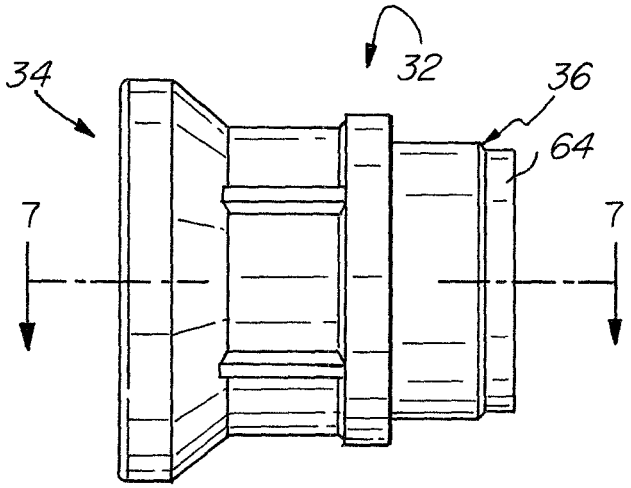
FIG. 5 is a bottom view of the push-on type grounding bushing.
Figure 6:
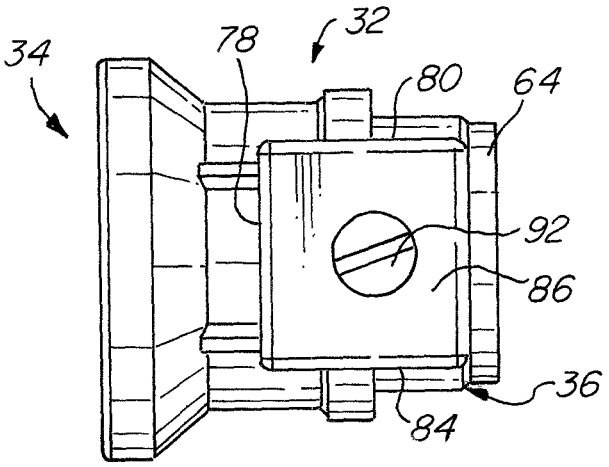
FIG. 6 is a top view of the push-on type grounding bushing.
Figure 7:
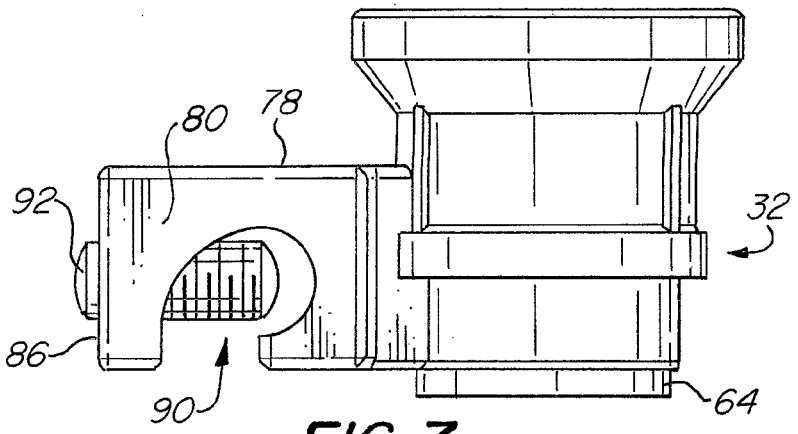
FIG. 7 is a view of the push-on type grounding bushing showing the lug extending to the left of the first terminating end of the body of the grounding bushing.

As seen in FIGS. 1 and 2, a washer 46 and a locking device 48 are secured inside first end 34 of body 32 prior to rolling over the end of the first body so as to secure the washer and locking device therein as shown in FIG. 1. The rolled over first end 34 capturing washer 36 and locking device 48 is best seen in FIG. 8.

FIG. 8 is a cross-sectional view of the grounding bushing showing the internal bore 38 at the first end of body 32, this bore dimensioned for receipt of a conduit 44 as seen in FIG. 11. As seen in FIG. 8, an intermediate shoulder stop 40 is dimensioned to stop the conduit end 42 as shown in FIG. 11. Adjacent this intermediate shoulder stop is at least one contact rib 50. Each contact rib extends radially into the first bore 38 thereby effectively reducing the diameter of the bore within body 32 and each contact rib thereby extends radially into body 32 by an increasing radial dimension while progressing axially or longitudinally relative to body 32. These contact ribs electrically bond the conduit 44 to the grounding bushing.

As disclosed in applicant's U.S. Pat. No. 8,274,000, there are preferably three contact ribs 50 equally spaced 120° apart from each other within the bore 38. As also discussed in applicant's U.S. Pat. No. 8,274,000, adjacent to the first end 34 of body 32 is a conical portion 52 and a shoulder 53. The shoulder is dimensioned to receive a flat rim 54 of the locking device 48. Attached to the flat rim is a tapered angled portion which is attached to a flat ramp 58 on which gripping tabs 60 are placed. One end of the flat ramp 58 is displaced approximately 2° from the plane of the flat rim 58 and thus the flat rim has a slope or pitch of approximately 2°. The gripping tabs 60 are equally spaced and have an equal length but are displaced axially relative to the longitudinal axis of body 32 thereby forming a helix or spiral. The teeth themselves are slightly twisted to facilitate their gripping action. In addition, the equal length of the plurality of gripping tabs 60 helps to uniformly hold the conduit 44. The gripping tabs are dimensioned to flex and are angled inward away from the circular aperture or opening 62. The conduit is thus held in place by pushing it into the first end of the bushing while it can be removed by rotating it relative to the bushing as shown by arrow 61 (see FIG. 9 and FIG. 21—for a second embodiment of the invention—).

As seen in FIGS. 1, 2 and 8, the grounding bushing also includes a throat insulator 64 that has a stepped outer perimeter that mates with the decreasing diameter stepped interior wall 39 formed in body 32 so as to snuggly fit into the second end 36 of the body. This throat insulator is preferably fabricated from plastic and has a flange 69 dimensioned to substantially cover the second end 36 of the body, so as to minimize chafing of electrical conductors 70 emanating out of the second end of the grounding bushing as seen in FIG. 11.

Body 32 includes an integral lug 72 formed from an electrically conductive material, such as zinc alloy metal or other non-zinc alloy metal. The lug includes a base 74 which in this embodiment is integrally formed with the remainder of body 32. The lug also includes first, second, third and fourth sides 78, 80, 82 and 84 respectively and a top 86.

Figure 10:
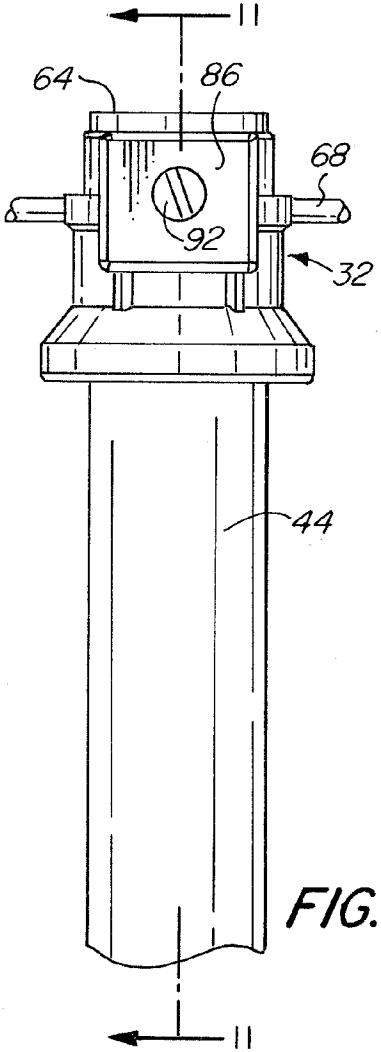
FIG. 10 is a top view of the push-on type grounding bushing and the conduit as shown in FIG. 9 without a grounding conductor positioned therein.

Lug 72 includes a bore 88 that passes through the first side 78 of the lug and extends into a lay-in recess 90 that is formed between the second and fourth sides 82 and 84 and opens both at the second and fourth sides 84, as well as at the third side 82. The lay-in recess allows a conductor 68 to be placed therein as best seen in FIGS. 10 and 11 and to be secured in the lay-in recess by means of a set screw 92 or other fastener threaded into a threaded bore 94 passing through the top 86 of lug 72.

Figure 9:
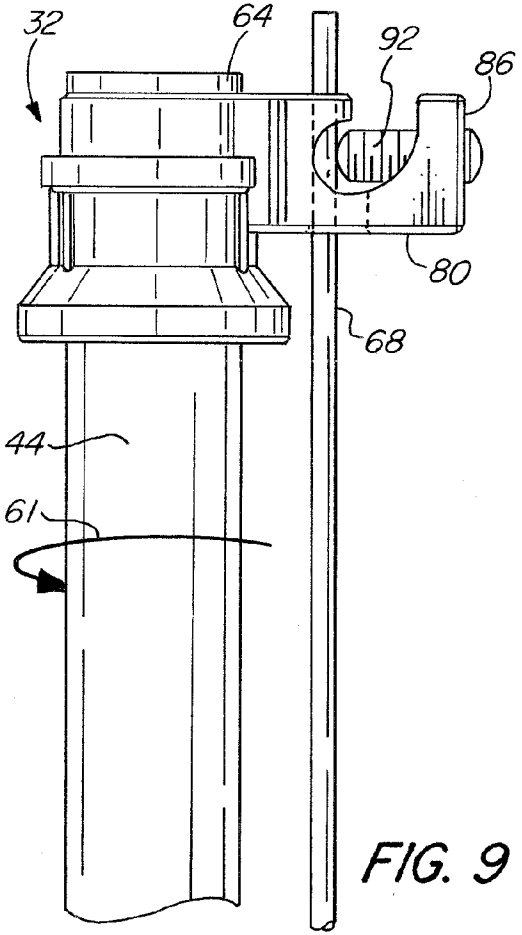
FIG. 9 shows the push-on type grounding bushing with a conduit positioned therein and a grounding conductor secured to the lug through an orifice formed in the lug.

In addition, bore 88 allows for an electrical conductor 70 to be secured to the lug by the same set screw 92 in the manner as shown in FIG. 11. Indeed, the set screw 92 in conjunction with bore 88 and lay-in recess 90 allows for a conductor to be secured to the lug both via the lay-in recess 90 and the bore 88 in the manner as shown in FIG. 11. Thus, FIG. 9 shows an arrangement where the grounding bushing can be grounded to an earth ground via conductor 68 which passes outside of conduit 44 and FIG. 10 shows another arrangement in which the grounding bushing can be secured to an earth ground conductor 68 via the lay-in recess 90 and finally FIG. 11 shows in phantom an arrangement where the grounding bushing can bond a conductor 70 emanating out of conduit 44 while the grounding bushing is bonded to earth ground via an electrical conductor 68 secured to the grounding bushing via the lay-in recess 90 (as shown on FIG. 10).

Figure 12:
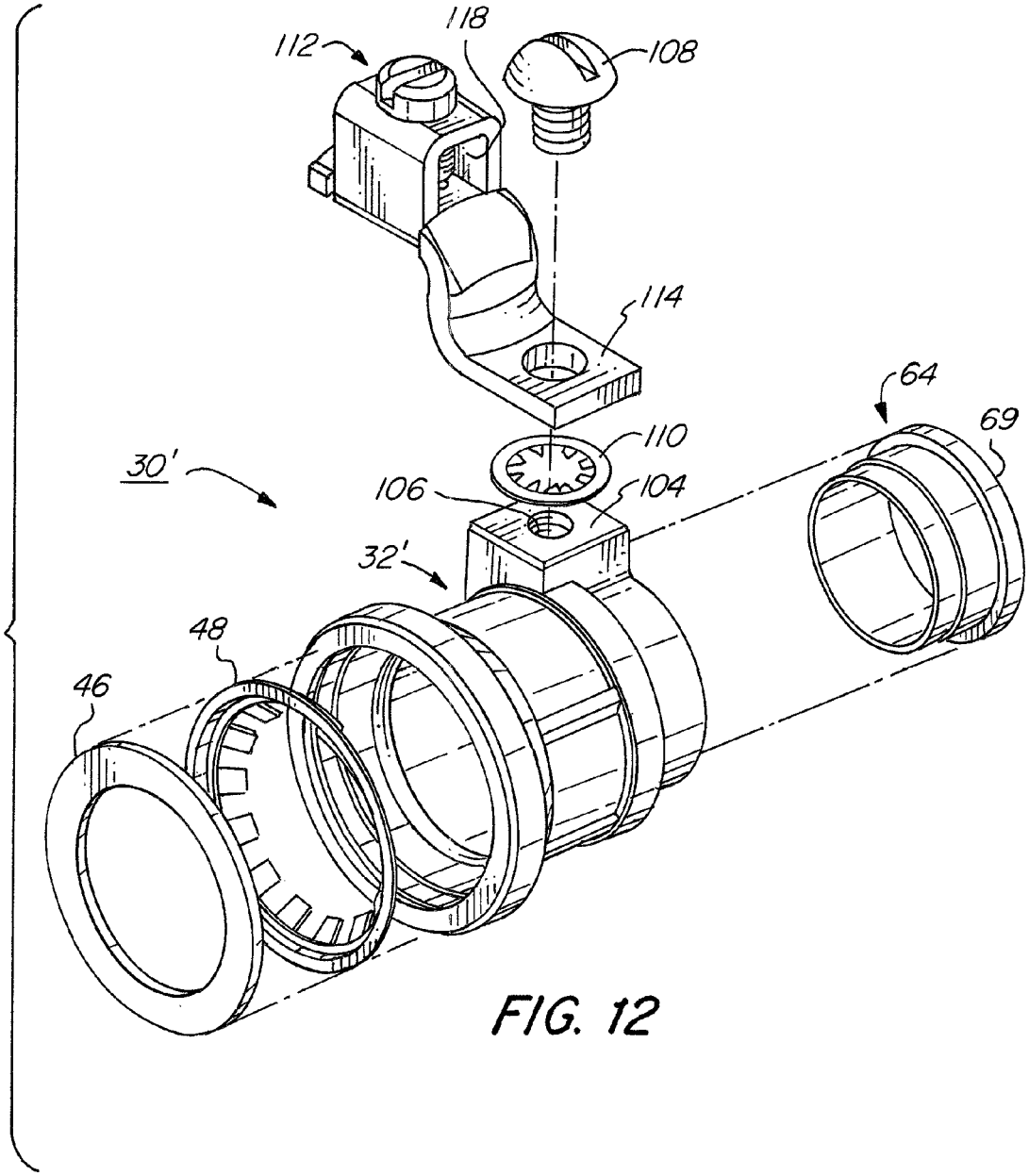
FIG. 12 is an exploded perspective view of the push-on type grounding bushing according to a second embodiment having a lug secured to a boss on the housing of the grounding bushing.
Figure 13:
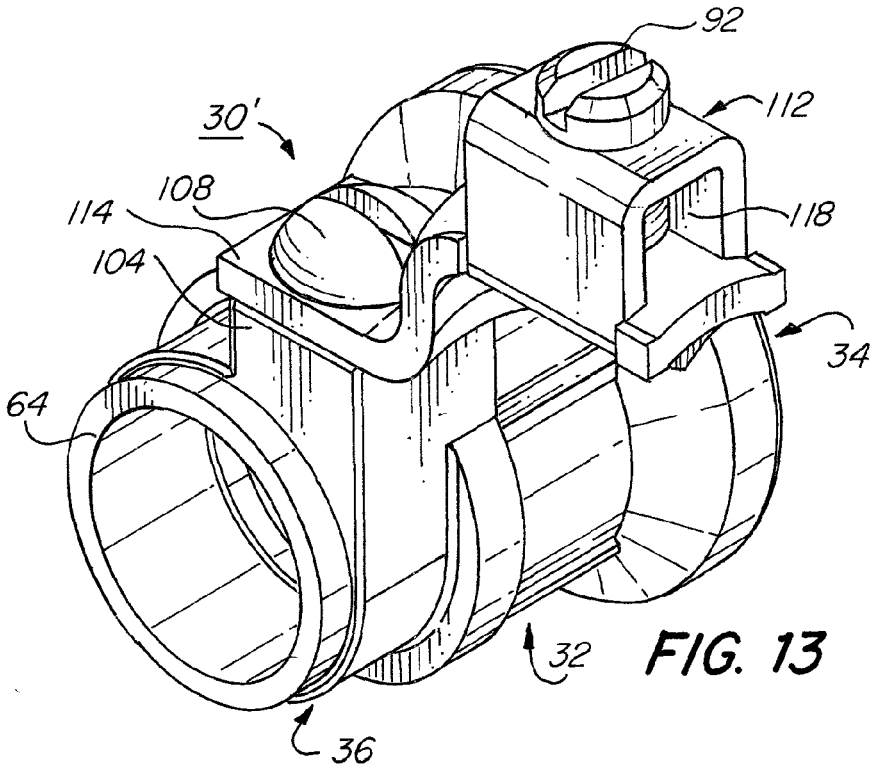
FIG. 13 is a rear perspective view of the push-on type grounding bushing shown in FIG. 12.
Figure 14:
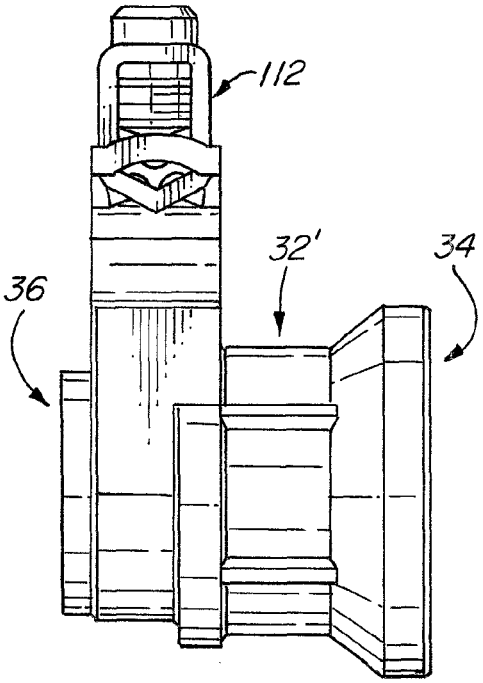
FIGS. 14 and 15 are opposite side views of the push-on type grounding bushing shown in FIG. 13.
Figure 15:
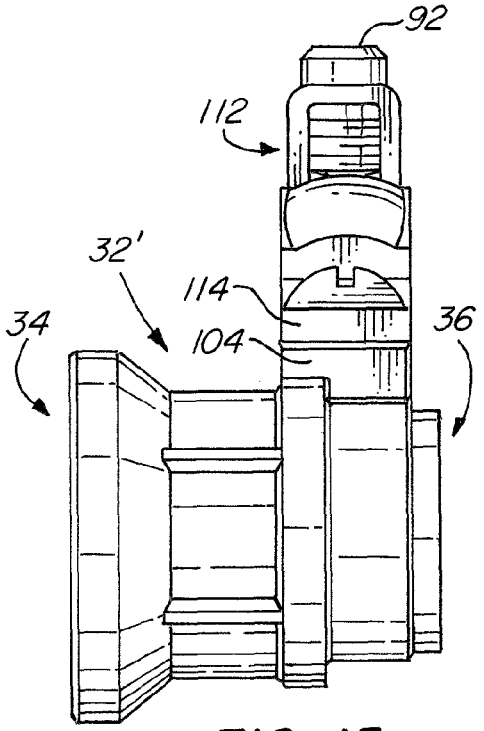
Figure 16:
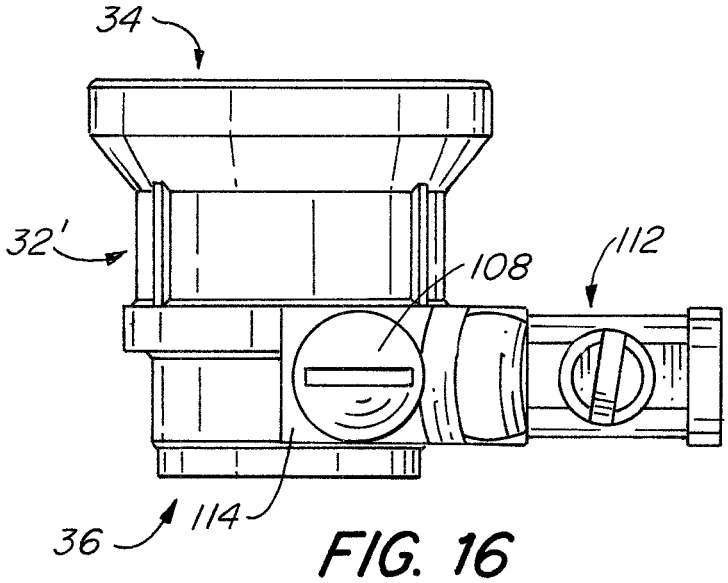
FIG. 16 is a top view of the push-on type grounding bushing shown in FIG. 13.
Figure 17:
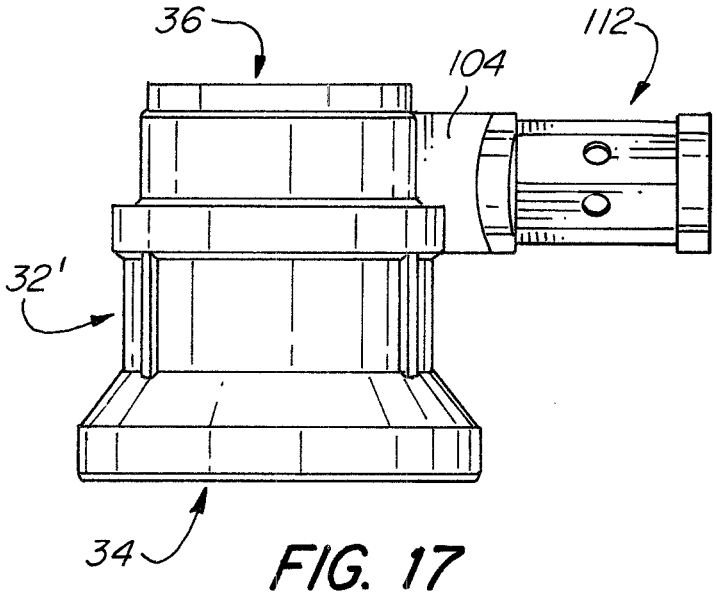
FIG. 17 is a bottom view of the push-on type grounding bushing shown in FIG. 13.
Figure 18:
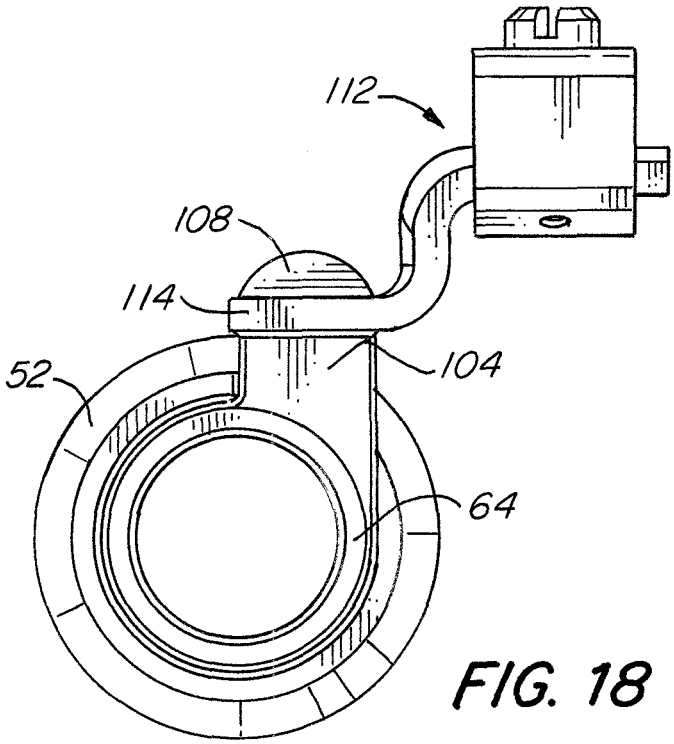
FIG. 18 is a rear view of the push-on type grounding bushing shown in FIG. 13.
Figure 19:
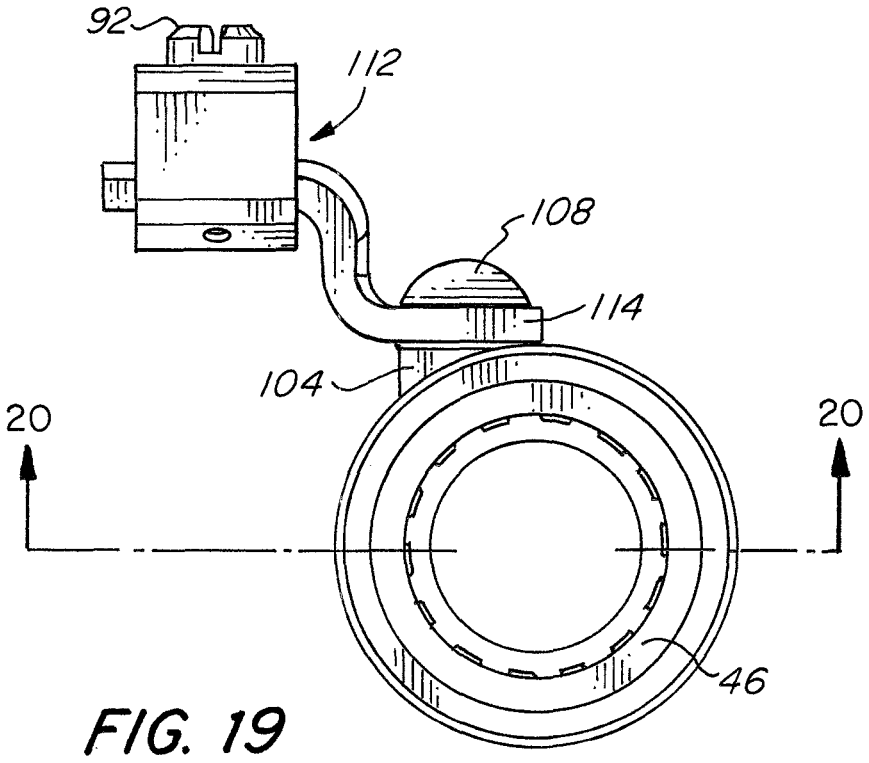
FIG. 19 is a front view of the push-on type grounding bushing shown in FIG. 13.
Figure 20:
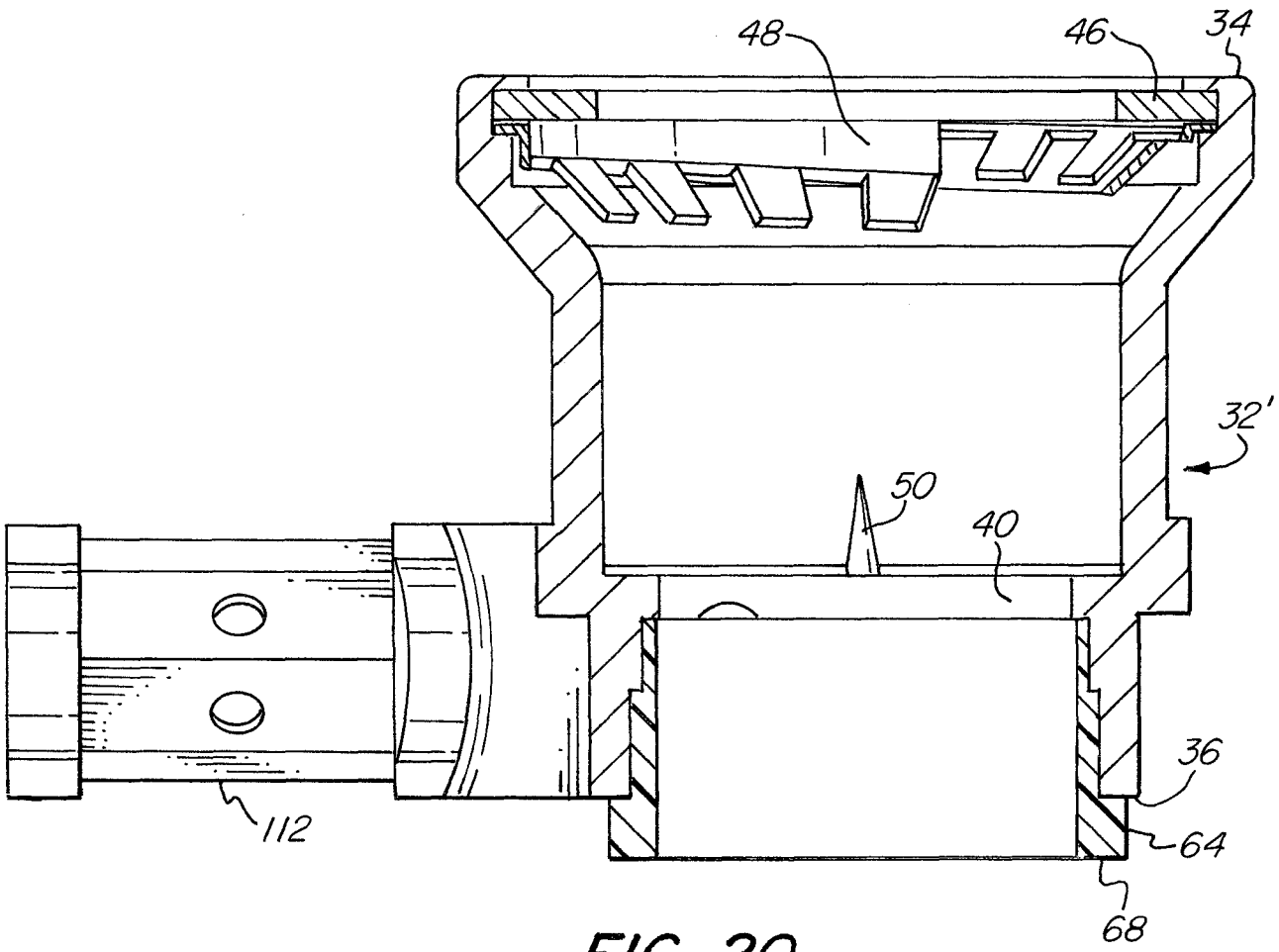
FIG. 20 is a cross-sectional view of the push-on type grounding bushing taken along line 20-20 of FIG. 19.

FIGS. 23-28 illustrate an embodiment of the lug 72' as a separate component having a bore 88', a threaded bore 94' and a lay-in recess 90' of similar character as that of the integral lug 72 described above. Lug 72' includes a base 74' that includes an extension 100 having a bore 102 formed therein so as to secure lug 72' to a body 32' forming an embodiment of the grounding bushing, such as shown in FIG. 12. In the embodiment shown in FIG. 12, the body 32' of the grounding bushing includes a boss 104 having a threaded aperture 106 for receipt of a machine screw or similar fastener 108.

Figure 21:
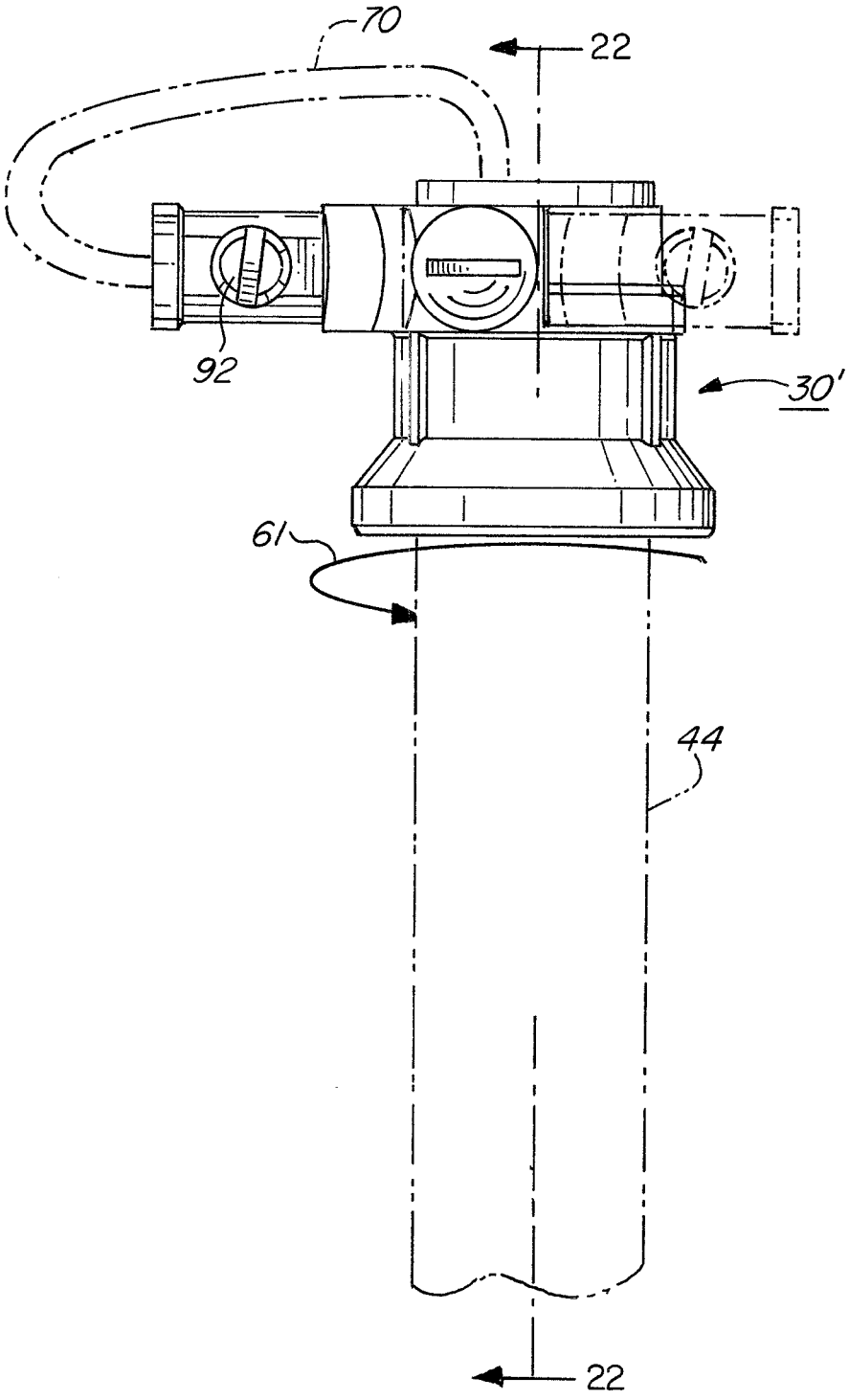
FIG. 21 is a view of the push-on type grounding bushing with a grounding conductor emanating out of a conduit secured in the grounding bushing, the grounding conductor bonded to the lug of the grounding bushing.
Figure 22:
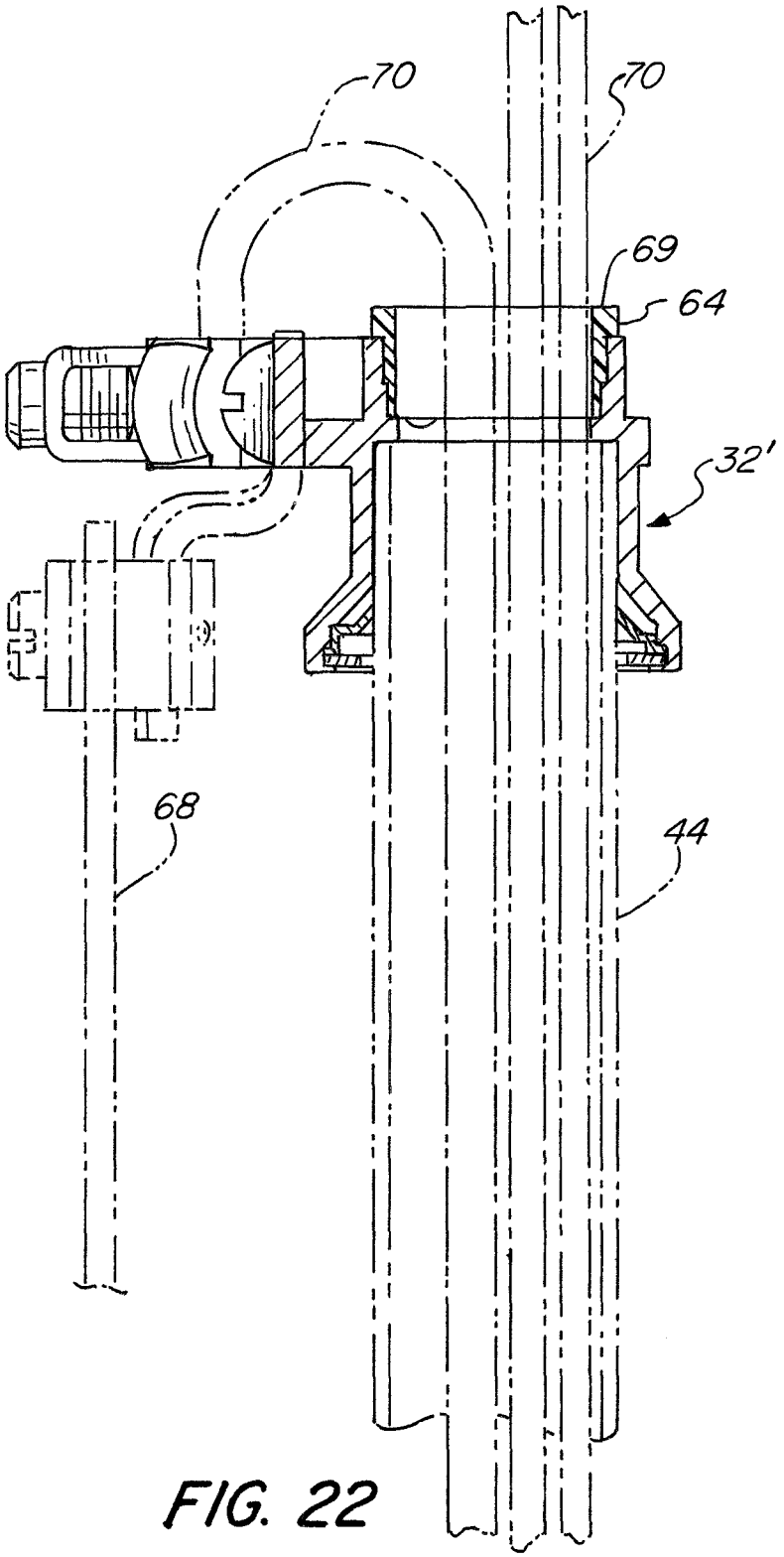
FIG. 22 is a cross-sectional view of the push-on type grounding bushing and conduit shown in FIG. 21 taken along line 22-22 of FIG. 21 and further showing that the lug can be rotated (such as the illustrated 90°) as shown in phantom for securing to an additional grounding conductor.
Figure 23:
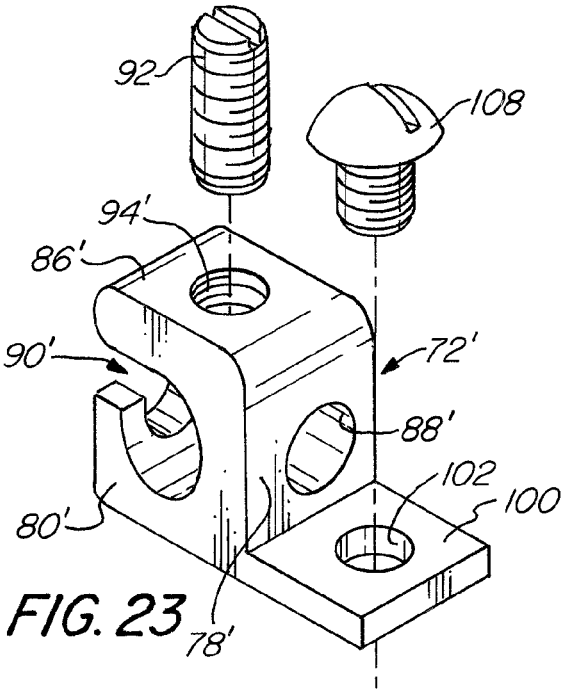
FIG. 23 is a perspective view of a lay-in type lug according to the present invention.
Figure 24:
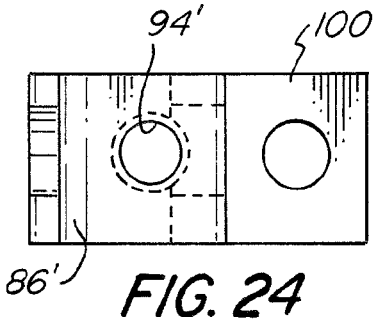
FIG. 24 is a top view of the lug as shown in FIG. 23.
Figure 25:
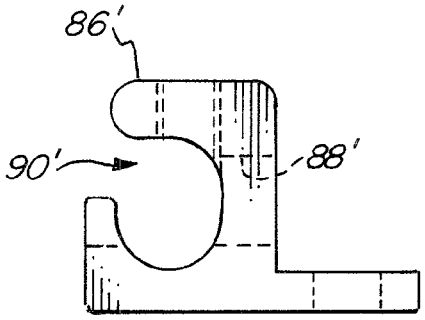
FIG. 25 is a side view of the lug as shown in FIG. 23.
Figure 26:
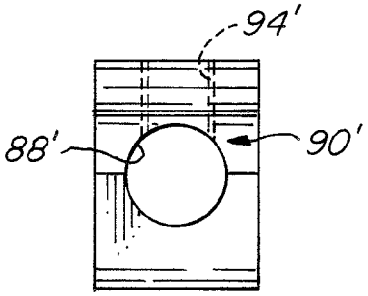
FIG. 26 is an end view of the lug shown in FIG. 23.
Figure 28:
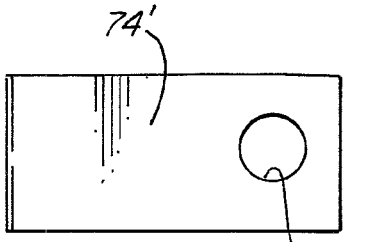
FIG. 28 is a bottom of the lug shown in FIG. 23.
Figure 27:
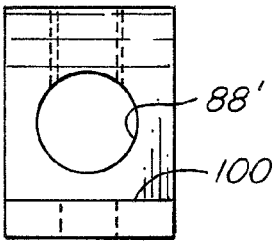
FIG. 27 is a rear view of the lug shown in FIG. 23.

FIGS. 12-22 show another embodiment of the grounding bushing 30' which has corresponding components to that of the grounding bushing embodiment 30 illustrated in FIGS. 1-11, except that the lug 112 is not a lay-in lug, but rather has a base 114 with a bore 116 formed therein for passage of a machine screw 108 so as to secure the lug to a boss 104 formed in body 32'. The lug 112 has a recess 118 for passage of electrical conductors 68 and/or 70 as best seen in FIGS. 21 and 22. The lug is secured to the boss via machine screw or similar fastener 108 and lock washer 110. A machine or set screw or similar fastener 92 secures a conductor 70 (see FIG. 21) to the lug.

As seen in FIGS. 21 and 22, the lug 112 can be turned relative to boss 104 so as to have an orientation best suited for connection to an electrical conductor depending upon where the electrical conductor is positioned either emanating out of conduit 44 or a conductor outside of conduit 44. The remainder of the grounding bushing 30' is the same as that for the embodiment shown in FIGS. 1-11.

Thus, what has been described is a push-on type grounding bushing having a lug associated therewith. The lug can be a lay-in-type lug either integrally formed with the body of the grounding bushing or as a component attached thereto. The lay-in lug has the advantageous feature of allowing electrical conductors to be secured thereto being in mutually perpendicular directions and thus facilitating use of the grounding bushing, especially when the grounding bushing has an integral lug since the conductors can have various orientations relative to each other which are easily accommodated by the grounding bushing. In addition, the grounding bushing may have a lug where the electrical conductors are secured in a recess, but where the lug is positionable relative to the body of the grounding bushing by means of securing the lug to the grounding bushing via a machine screw and boss formed on the body of the grounding bushing.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A push-type grounding bushing comprising:

an electrically conductive body having a first end and a second end, with a bore formed therethrough, the body further having an intermediate shoulder stop formed therein dimensioned to contact an end of a conduit passing into the body from said first end;

a locking device placed in the first end of the body having a plurality of gripping tabs forming a helix so that the conduit can be pushed into said locking device and held by said plurality of gripping tabs and removed by rotating the conduit relative to the body, a throat insulator dimensioned for placement into the second end of the body, the throat insulator having a flange dimensioned to substantially cover said second end, the throat insulator having a bore formed therein for passage of electrical conductors extending out of said conduit;

an electrically conducting lug secured to said body, the lug having a base, first, second, third and fourth sides and a top, the first and third sides opposite each other, the second and fourth sides opposite each other, and the base and top opposite each other, the lug having a rectangular cuboid shape, the lug having a lay-in recess formed between the second and fourth sides and having an opening thereto extending across the third side, the lay-in recess dimensioned for lay-in placement of an electrical conductor through the opening in the third side so as to extend across the second and fourth sides, the lug having a bore formed through the first side and extending into a portion of the lay-in recess so as to allow an electrical conductor to pass through the bore, the portion of the lay-in recess, and a cutout formed in the opening extending across the third side, and the lug having a threaded bore formed through the top and extending into said lay-in recess; and a fastener configured to mechanically and electrically secure said conductor received in said lay-in recess or in said bore formed through the first side, to said lug.

2. The push-type grounding bushing according to claim 1, wherein said recess of said lug is dimensioned for receipt of an electrical conductor extending out of said conduit.

3. The push-type grounding bushing according to claim 1, wherein the locking device has a plurality of gripping tabs forming a helix.

4. The push-type grounding bushing according to claim 3, wherein at least some of said gripping tabs have a twist formed therein.

5. The push-type grounding bushing according to claim 4, wherein the first end of the electrically conductive body is rolled over so as to secure the locking device to said body.

6. The push-type grounding bushing according to claim 5, further comprising a washer positioned adjacent the locking device and also secured to the rolled over first end of the body.

7. The push-type grounding bushing according to claim 5, wherein the lug is integrally attached to said body.

8. The push-type grounding bushing according to claim 5, wherein the body includes a boss dimensioned for securing the lug and wherein the base of the lug includes a flat extension having a bore formed therein to allow passage of a fastener to secure the lug to the boss of the bushing.

9. The push-type grounding bushing according to claim 1, wherein an interior wall of the body between the second end of the body and the intermediate shoulder stop has a decreasing diameter stepped configuration and wherein the throat insulator has a corresponding outer wall dimensioned to mate with said stepped configuration of said interior wall.

10. The push-type grounding bushing according to claim 1, wherein the base of the lug is integrally formed on the body of the bushing.

11. The push-type grounding bushing according to claim 1, further comprising a contact rib formed on the intermediate shoulder stop extending into the bore in said body toward said first end of the body by an increasing radial dimension.

12. The push-type grounding bushing according to claim 1, further comprising a washer positioned adjacent the locking device and placed in the first end of the body.

13. The push-type grounding bushing according to claim 1, wherein the body includes a boss dimensioned for securing the lug and wherein the base of the lug includes a flat extension having a bore formed therein to allow passage of a fastener to secure the lug to the boss of the bushing.

14. A lay-in type lug for attachment to a push-type grounding bushing having a boss dimensioned for receipt of said lug, the lug comprising a base, first, second, third and fourth sides and a top, the first and third sides opposite each other, the second and fourth sides opposite each other, and the base and top opposite each other the lug having a rectangular cuboid shape, the base including a flat extension having a bore formed therein to allow passage of a fastener to secure the lug to the boss of the bushing, the lug having a lay-in recess formed between the second and fourth sides and having an opening thereto extending across the third side, the lay-in recess dimensioned for lay-in placement of an electrical conductor through the opening in the third side so as to extend across the second and fourth sides, the lug having a bore formed through the first side and extending into a portion of the lay-in recess so as to allow an electrical conductor to pass through the bore, the portion of the lay-in recess, and a cutout formed in the opening extending across the third side, and the lug having a threaded bore formed through the top and extending into said lay-in recess, said threaded bore for receipt of a fastener configured to mechanically and electrically secure the electrical conductor received in said lay-in recess or in said bore formed through the first side, to said lug.

* * * * *